US011081076B2

(12) United States Patent
Im et al.

(10) Patent No.: US 11,081,076 B2
(45) Date of Patent: Aug. 3, 2021

(54) DISPLAY DEVICE CONTROLLING AN OUTPUT TIMING OF A DATA SIGNAL

(71) Applicant: SAMSUNG DISPLAY CO., LTD., Yongin-si (KR)

(72) Inventors: Taegon Im, Gwangmyeong-si (KR); Jae-Han Lee, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/383,004

(22) Filed: Apr. 12, 2019

(65) Prior Publication Data

US 2019/0333465 A1 Oct. 31, 2019

(30) Foreign Application Priority Data

Apr. 26, 2018 (KR) ..... 10-2018-0048729

(51) Int. Cl.
*G09G 3/36* (2006.01)

(52) U.S. Cl.
CPC ... *G09G 3/3688* (2013.01); *G09G 2310/0286* (2013.01); *G09G 2310/0291* (2013.01); *G09G 2310/061* (2013.01); *G09G 2310/08* (2013.01)

(58) Field of Classification Search
CPC ..... G09G 3/3688; G09G 2310/0286; G09G 2310/0291; G09G 2310/061; G09G 2310/08
See application file for complete search history.

(56) References Cited

U.S. PATENT DOCUMENTS

| | | | | |
|---|---|---|---|---|
| 9,466,263 | B2 * | 10/2016 | Bae | G09G 3/3225 |
| 2007/0290983 | A1 | 12/2007 | Kim et al. | |
| 2017/0323611 | A1 | 11/2017 | Jo et al. | |

FOREIGN PATENT DOCUMENTS

| | | |
|---|---|---|
| KR | 10-0795687 | 1/2008 |
| KR | 10-1696469 | 1/2017 |
| KR | 10-1739137 | 5/2017 |
| KR | 10-2017-0126568 | 11/2017 |
| KR | 10-1808344 | 12/2017 |

* cited by examiner

*Primary Examiner* — Kenneth B Lee, Jr.
(74) *Attorney, Agent, or Firm* — F. Chau & Associates, LLC

(57) ABSTRACT

A display device includes a signal controller configured to provide data and a frame control signal, a display panel including first to m-th data line groups, and a data driver configured to receive the data and the frame control signal, and output a data signal corresponding to the data to the first to m-th data line groups. The data driver includes first to m-th data driving circuit units electrically connected to the first to m-th data line groups in one-to-one correspondence, Each of the first to m-th data driving circuit units includes a clock adjustment unit configured to generate a second clock signal using a first clock signal and the frame control signal. The second clock signal controls an output timing of the data signal to be transmitted to a first channel among a plurality of channels of each of the first to m-th data line groups.

20 Claims, 9 Drawing Sheets

DISPLAY DEVICE CONTROLLING AN OUTPUT TIMING OF A DATA SIGNAL

CROSS-REFERENCE TO RELATED APPLICATION

This U.S. non-provisional patent application claims priority under 35 U.S.C. § 119 to Korean Patent Application No. 10-2018-0048729, filed on Apr. 26, 2018 in the Korean Intellectual Property Office, the disclosure of which is incorporated by reference herein in its entirety.

TECHNICAL FIELD

Exemplary embodiments of the inventive concept relate to a display device including a data driver that controls an output timing of a data signal to be output to a display panel.

DISCUSSION OF RELATED ART

A display device includes a display panel for displaying an image, and a data driver and a gate driver for driving the display panel. The display panel includes a plurality of gate lines, a plurality of data lines, and a plurality of pixels. The data driver may include a plurality of data driving circuit units. The plurality of data driving circuit units respectively output data signals to the data lines, and the gate driver outputs gate signals to the gate lines. A gate-on voltage is applied to a gate electrode of a thin film transistor connected to each of the gate lines, and then a data signal corresponding to a display image is applied to a source electrode of the thin film transistor to display the display image. The gate signal output from the gate driver may be delayed on a delivery path. In this case, when an output timing of the data signal is not controlled between the plurality of data driving circuit units, a pixel charging time may vary according to a position in the display panel, and accordingly, a luminance difference may occur in the display panel.

SUMMARY

According to an exemplary embodiment of the inventive concept, a display device includes a signal controller configured to provide data and a frame control signal; a display panel including first to m-th data line groups, where m is a positive integer of 2 or greater; and a data driver configured to receive the data and the frame control signal, and output a data signal corresponding to the data to the first to m-th data line groups. The data driver includes first to m-th data driving circuit units electrically connected to the first to m-th data line groups in one-to-one correspondence. Each of the first to m-th data driving circuit units includes a clock adjustment unit configured to generate a second clock signal using a first clock signal and the frame control signal. The second clock signal controls an output timing of the data signal to be transmitted to a first channel among a plurality of channels of each of the first to m-th data line groups.

In an exemplary embodiment of the inventive concept, active periods, in each of which the data signal is output to the display panel, and a blank period between the active periods may be defined. The frame control signal may have a first level in the blank period, and the frame control signal may swing between a second level and a third level higher than the second level in the active periods.

In an exemplary embodiment of the inventive concept, a time width of the first level may be larger than that of the second level, and the first level and the second level may have a substantially identical level.

In an exemplary embodiment of the inventive concept, each of the first to m-th data driving circuit units may adjust a frequency of an internal clock signal in response to the first level of the frame control signal.

In an exemplary embodiment of the inventive concept, when the data corresponding to one frame is input to each of the first to m-th data driving circuit units, the first clock signal may be activated.

In an exemplary embodiment of the inventive concept, each of the first to m-th data driving circuit units may further include a clock shifter configured to receive the second clock signal to generate a plurality of second clock-delayed signals, and the plurality of second clock-delayed signals may control an output timing of the data signal to be transmitted to each channel except the first channel among the plurality of channels.

In an exemplary embodiment of the inventive concept, a first time interval between a first output timing of the data signal to be transmitted to the first channel of the first data line group and a second output timing of the data signal to be transmitted to a second channel of the first data line group may be substantially identical to a second time interval between a third output timing of the data signal to be transmitted to a last channel of the first data line group and a fourth timing of the data signal to be transmitted to a first channel of the second data line group.

In an exemplary embodiment of the inventive concept, a part of the first to m-th data driving circuit units may perform an AND operation on the first clock signal and the frame control signal to generate the second clock signal, and another part of the first to m-th data driving circuit units may generate an inverted frame control signal from the frame control signal and performs an AND operation on the inverted frame control signal and the first clock signal to generate the second clock signal.

In an exemplary embodiment of the inventive concept, the clock adjustment unit may include an inverter and an AND gate.

In an exemplary embodiment of the inventive concept, a duty ratio of the frame control signal may be adjusted to adjust a time interval between a first output timing of the data signal to be transmitted to a first channel of the first data line group and a second output timing of the data signal to be transmitted to a first channel of the second data line group.

In an exemplary embodiment of the inventive concept, each of the first to m-th data driving circuit units may further include: a shift register configured to output latch clock signals; a first latch unit configured to receive the data in correspondence to the latch clock signals; and a second latch unit configured to receive the data from the first latch unit and the second clock signal from the clock adjustment unit. The second latch unit outputs the data at a prescribed timing according to a control of the second clock signal.

In an exemplary embodiment of the inventive concept, each of the first to m-th data driving circuit units may further include: a decoder configured to convert the data stored in the second latch unit to the data signal in a period in which the second clock signal is activated; and an output buffer configured to output the data signal to the display panel.

According to an exemplary embodiment of the inventive concept, a display device includes: a signal controller configured to provide a frame control signal, and data including image data output in an active period and training data output in a blank period; a display panel including first to m-th data line groups, where m is a positive integer of 2 or greater; and a data driver including first to m-th data driving circuit units electrically connected to first to m-th data line groups in one-to-one correspondence. Each of the first to m-th data driving circuit units includes a clock adjustment unit configured to use the frame control signal and a first clock signal to generate a second clock signal for controlling an output timing of a data signal corresponding to the image data, and the frame control signal has a waveform having a low level in the blank period, and swinging between the low level and a high level in the active period.

In an exemplary embodiment of the inventive concept, a phase difference between the second clock signal generated by the clock adjustment unit of the first data driving circuit unit and the second clock signal generated by the clock adjustment unit of the second data driving circuit unit may be determined by a duty ratio of the frame control signal in the active period.

In an exemplary embodiment of the inventive concept, the clock adjustment unit of the first data driving circuit unit may perform an AND operation on the first clock signal and the frame control signal to generate the second clock signal, and the clock adjustment unit of the second data driving circuit unit, which is adjacent to the first data driving circuit unit, may perform an AND operation on the first clock signal and an inverted frame control signal obtained by inverting the frame control signal to generate the second clock signal.

In an exemplary embodiment of the inventive concept, each of the first to m-th data line groups may include a plurality of channels, and the second clock signal controls an output timing of a first channel, through which the image data is output first, among the plurality of channels.

In an exemplary embodiment of the inventive concept, each of the first to m-th data driving circuit units may further include a clock shifter configured to receive the second clock signal to generate a plurality of second clock-delayed signals, and the plurality of second clock-delayed signals control an output timing of the data signal to be transmitted to each of the plurality of channels except the first channel.

According to an exemplary embodiment of the inventive concept, a display device includes: a display panel including first to m-th data line groups, where m is a positive integer of 2 or greater; and a data driver including first to m-th data driving circuit units electrically connected to first to m-th data line groups in one-to-one correspondence. At least one y-th data driving circuit unit, where y is an integer of 2 to m, among the first to m-th data driving circuit units includes a timing controller configured to receive a control signal from a (y-1)-th data driving circuit unit and generate control-delayed signals using the control signal. Each of the first to m-th data line groups is divided into x channels, where x is an integer of 2 or greater, and the control signal controls an output timing of a data signal corresponding to the data to be transmitted to an (x-k)-th channel, where k is an integer of 1 to (x-1), of the (y-1)-th data driving circuit unit.

In an exemplary embodiment of the inventive concept, the control signal may control an output timing of a data signal corresponding to the data to be transmitted to a first channel of the y-th data driving circuit unit, and each of the control-delayed signals may control an output timing of the data signal to be transmitted to each of the x channels except for the first channel of the y-th data driving circuit unit.

The display device may further include: a signal delivery line connecting the y-th data driving circuit unit to the (y-1)-th data driving circuit unit. The control signal is delivered from the (y-1)-th data driving circuit unit to the y-th data driving circuit unit through the signal delivery line.

BRIEF DESCRIPTION OF THE FIGURES

The above and other features of the inventive concept will become apparent by describing in detail exemplary embodiments thereof with reference to the accompanying drawings.

DETAILED DESCRIPTION OF THE EMBODIMENTS

Figure 1:
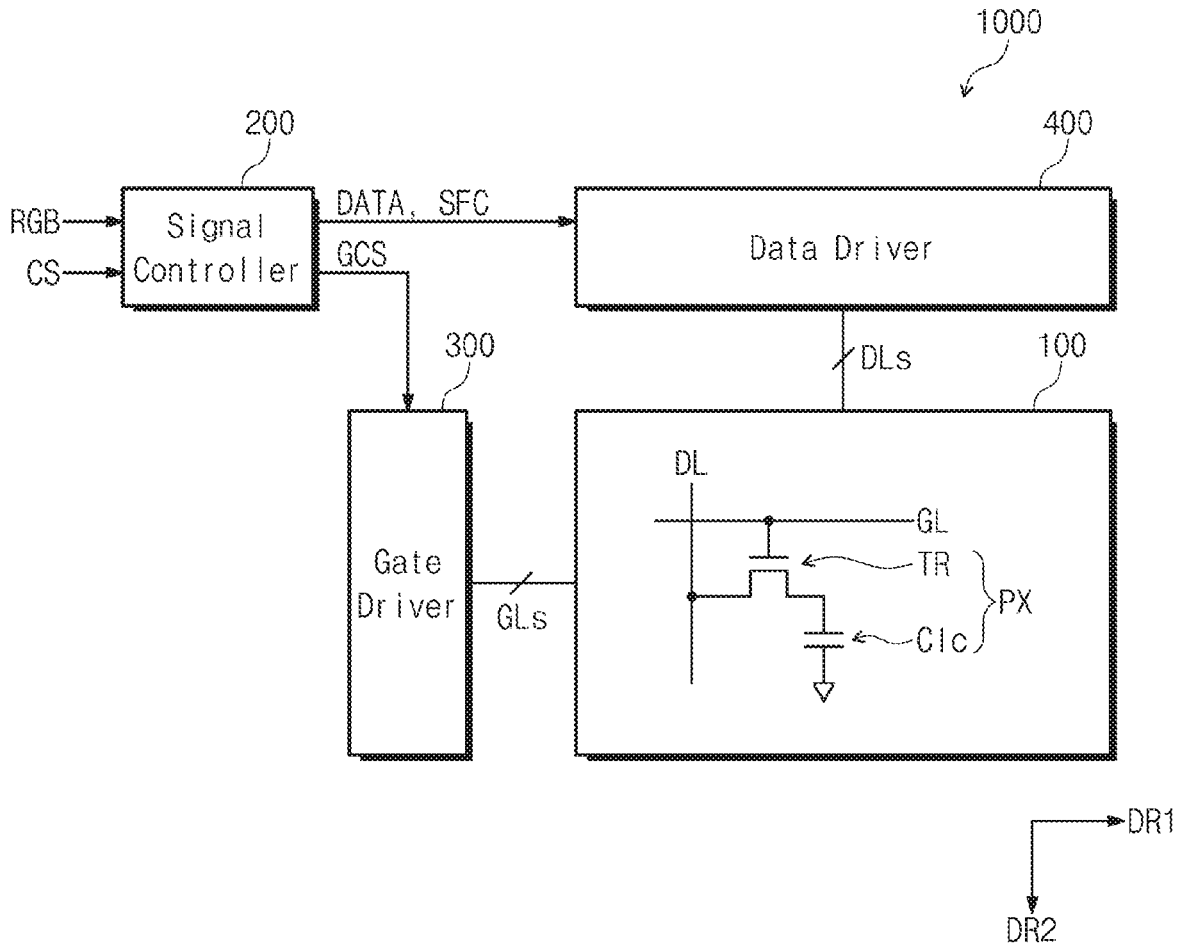
FIG. 1 is a block diagram of a display device according to an exemplary embodiment of the inventive concept.

Exemplary embodiments of the inventive concept provide a display device including a data driver capable of adjusting an output timing of a data signal.

Exemplary embodiments of the inventive concept will be described below in detail with reference to the accompanying drawings. Like reference numerals may refer to like elements throughout this application.

Figure 2:
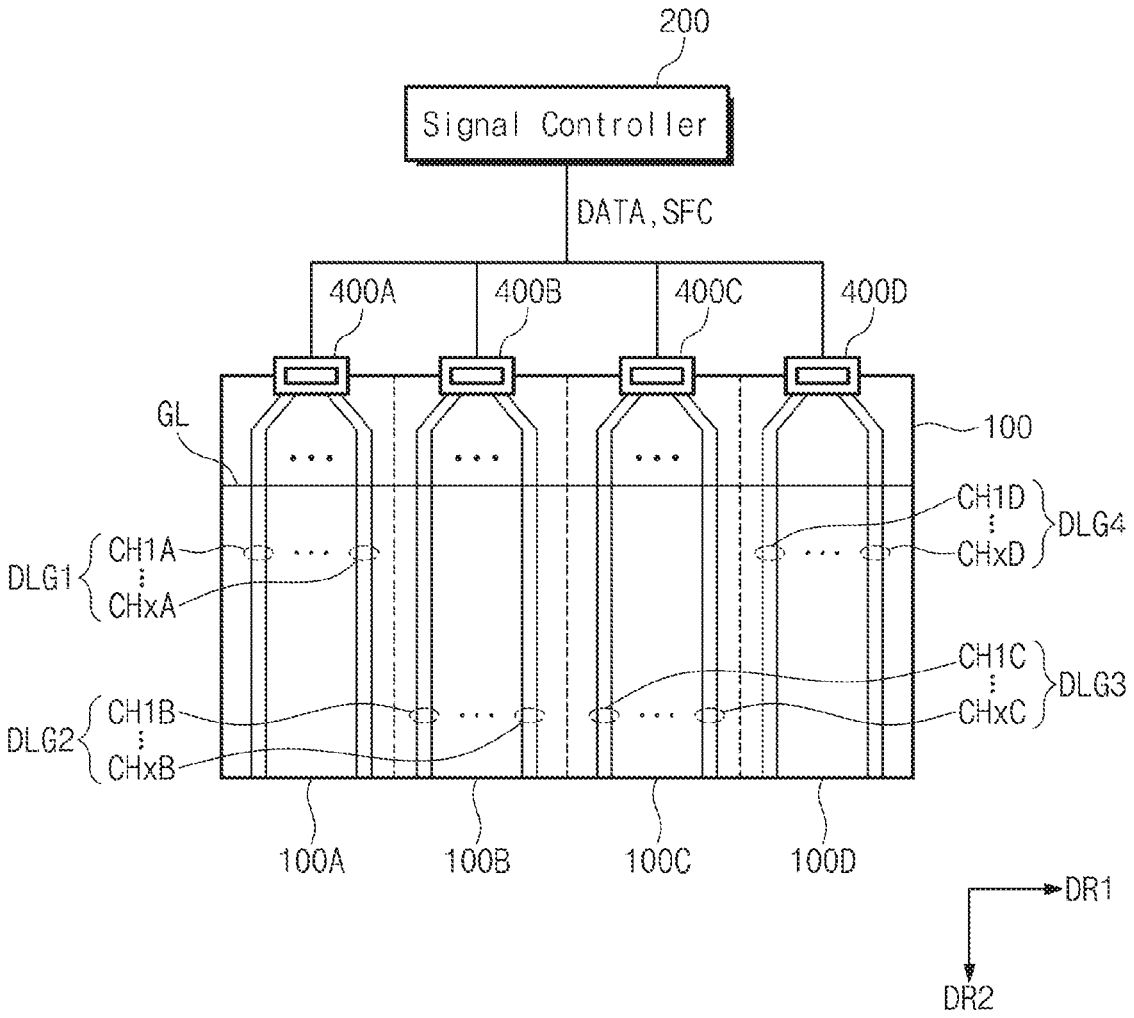
FIG. 2 is a partial block diagram of the display device of FIG. 1 according to an exemplary embodiment of the inventive concept.

FIG. 1 is a block diagram of a display device according to an exemplary embodiment of the inventive concept, and FIG. 2 is a partial block diagram of the display device of FIG. 1 according to an exemplary embodiment of the inventive concept.

Referring to FIGS. 1 and 2, a display device 1000 may include a display panel 100, a signal controller 200, a gate driver 300, and a data driver 400.

The display panel 100 may be one of various display panels including a liquid crystal display panel (LCD), an electrophoretic display panel, an electro-wetting display panel, a plasma display panel (PDP), an organic light-emitting diode (OLED), or the like. Hereinafter, descriptions will be provided for, for example, a case where the display panel 100 is an LCD.

The display panel 100 may include gate lines GLs, data lines DLs, and pixels PX. In FIG. 1, only one pixel PX connected to one gate line GL and one data line DL is shown. The pixel PX may display a primary color or a mixed color. The primary color may be red, green, or blue. The mixed color may be white, yellow, cyan, or magenta.

The pixel PX may include a thin film transistor TR and a capacitor Clc. The thin film transistor TR may be connected to the gate line GL and the data line DL. When the thin film transistor TR is turned on by a gate voltage input through the gate line GL, a data signal provided through the data line DL may be provided to the capacitor Clc. The capacitor Clc may be connected to the thin film transistor TR, and may include a liquid crystal layer in which the transmissivity of light is adjusted according to the voltage level.

The data lines DLs may be divided into first to m-th data line groups, where m may be a positive integer of 2 or greater, and in FIG. 2, a case where m is 4 is shown as an example. In this case, the data lines DLs may include a first data line group DLG1, a second data line group DLG2, a third data line groups DLG3, and a fourth data line group DLG4.

The display panel 100 may include a first display area 100A, a second display area 100B, a third display area 100C, and a fourth display area 100D arrayed along a first direction DR1. The first data line group DLG1, the second line group DLG2, the third data line group DLG3, and the fourth data line group DLG4 may be respectively disposed in the first display area 100A, the second display area 100B, the third display area 100C, and the fourth display area 100D.

Each of the first to fourth data line groups DLG1, DLG2, DLG3, and DLG4 may be divided into a plurality of channels. A single channel may have one or more data lines. In FIG. 2, as an example, the single channel has two data lines, but the inventive concept is not limited thereto. A single channel may include tens or hundreds of data lines. A plurality of data lines included in one channel may receive data signals corresponding to data DATA at substantially identical timing.

The number of the plurality of channels may be x, where x may be a positive integer of 2 or greater. The first data line group DLG1 may include first to x-th channels CH1A to CHxA, the second data line group DLG2 may include first to x-th channels CH1B to CHxB, the third data line group DLG3 may include first to x-th channels CH1C to CHxC, and the fourth data line group DLG4 may include first to x-th channels CH1D to CHxD.

FIG. 2 exemplarily shows that each of the first to fourth data line groups DLG1, DLG2, DLG3, and DLG4 includes an identical number of channels, but the inventive concept is not limited thereto. The number of channels included in each of the first to fourth data line groups DLG1, DLG2, DLG3, and DLG4 may be different from one another.

The signal controller 200 may be a timing controller. The signal controller 200 may receive image information RGB and a control signal CS from the outside. The control signal CS may include, for example, a vertical synchronization signal Vsync, a horizontal synchronization signal Hsync, a clock, etc.

The signal controller 200 may generate a gate control signal GCS on the basis of the control signal CS to deliver the same to the gate driver 300. The gate control signal GCS may include a signal for instructing a start of scan, a signal for controlling an output period of a gate-on voltage, and a signal for adjusting the duration of the gate-on voltage.

The gate driver 300 may drive the gate lines GLs such that a data signal is sequentially output to the display panel in response to the gate control signal GCS.

To meet the specification of the data driver 400, the signal controller 200 may change the format of the image information RGB to generate serialized data DATA, and deliver the generated data DATA to the data driver 400. The signal controller 200 may deliver the data DATA to the data driver 400 through a single channel. However, the above-described is exemplary, and the signal controller 200 may deliver the data DATA to the data driver 400 through a plurality of channels. In addition, the signal controller 200 may deliver a frame control signal SFC to the data driver 400.

The data driver 400 may output a gray scale voltage corresponding to the data DATA to the display panel 100 through the data lines DLs. The data driver 400 may include first to m-th data driving circuit units electrically connected to the first to m-th data line groups in one-to-one correspondence. FIG. 2 illustrates a case where m is 4 as an example. In this case, the data driver 400 may include a first data driving circuit unit 400A, a second data driving circuit unit 400B, a third data driving circuit unit 400C, and a fourth data driving circuit unit 400D.

The first data driving circuit unit 400A, the second data driving circuit unit 400B, the third data driving circuit unit 400C, and the fourth data driving circuit unit 400D are respectively and electrically connected to the first data line group DLG1, the second data line group DLG2, the third data line group DLG3, and the fourth data line group DLG4.

Referring to FIG. 2, the gate line GL may be extended along the first direction DR1. Accordingly, a gate signal provided to the gate line GL may be provided in the first direction DR1, and delayed while proceeding toward the first direction DR1. Each of the data lines DLs is extended in a second direction DR2 that intersects with the first direction DR1, and signals respectively provided to the data lines DLs may be provided in the second direction DR2.

The data driver 400 may generate a clock signal for controlling a timing at which the data DATA is output to the display panel 100 with reference to a delay of the gate signal. According to an exemplary embodiment of the inventive concept, the clock signal may be generated using the frame control signal SFC, or using a clock signal from a previous stage of an adjacent data driving circuit unit.

According to an exemplary embodiment of the inventive concept, the frame control signal SFC is commonly provided to the first to fourth data driving circuit units 400A, 400B, 400C and 400D from the signal controller 200. In other words, each of the first to fourth data driving circuit units 400A, 400B, 400C, and 400D generates the signal for controlling the output timings using the commonly provided signal, Since the output timings of the first to fourth data driving circuit units 400A, 400B, 400C, and 400D are adjusted using the common signal, the control accuracy of the output timing may be improved. In addition, since the output timings of the first to fourth data driving circuit units 400A, 400B, 400C, and 400D may be controlled only by controlling the single frame control signal SFC, the control of the output timings may be easier. The luminance difference due to the pixel charging times of the first to fourth display areas 100A, 100B, 100C, and 100D may be reduced, and the display quality may be improved due to improvement in luminance uniformity.

In addition, according to an exemplary embodiment of the inventive concept, a clock signal for controlling a first output timing of the data driving circuit unit may not be a clock signal for controlling the last output timing among the clock signals from the data driving circuit unit of the previous stage, but a clock signal for controlling a timing before the last output. Accordingly, since the first timing is controlled with reference to a time to be delayed in a process of receiving the clock signal, the output timings among the first to fourth data driving circuit units 400A, 400B, 400C, and 400D may be consecutively adjusted. Accordingly, a luminance difference due to charging time differences among the first to fourth display areas 100A, 100B, 100C, and 100D may be reduced, and the luminance uniformity may be enhanced to improve the display quality.

Figure 3A:
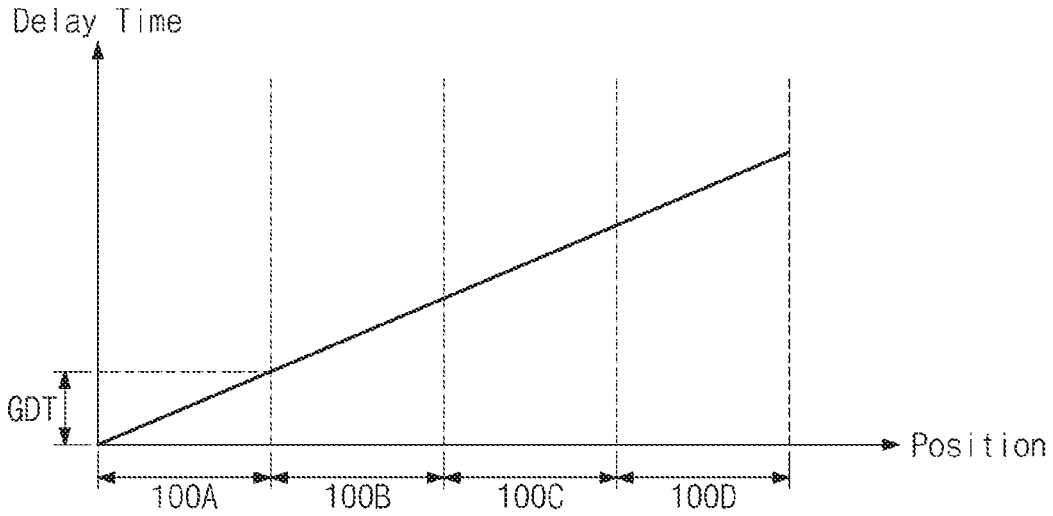
FIG. 3A is a graph illustrating a delay time of a gate signal according to a position of a display panel according to an exemplary embodiment of the inventive concept.
Figure 3B:
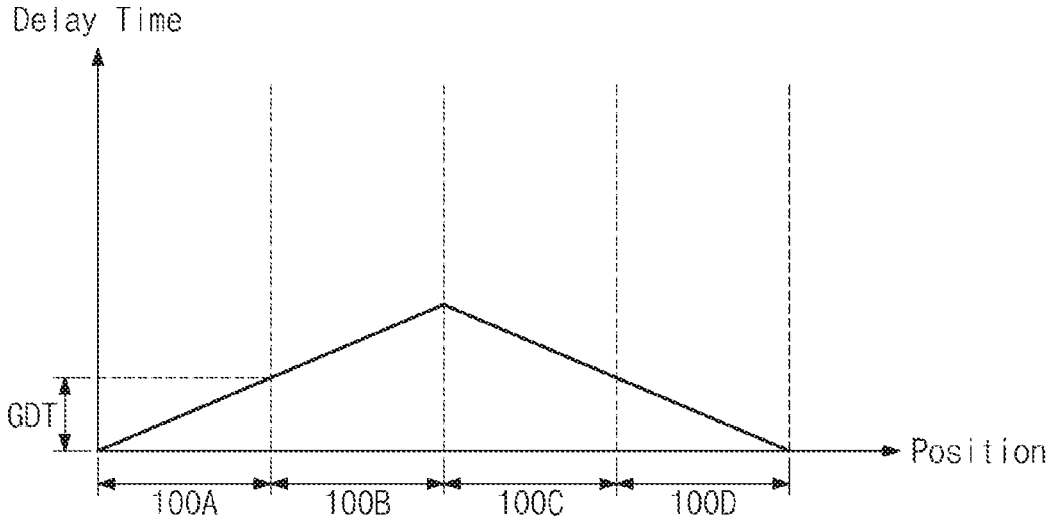
FIG. 3B is a graph illustrating a delay time of a gate signal according to a position of a display panel according to an exemplary embodiment of the inventive concept.

FIG. 3A is a graph illustrating a delay time of a gate signal according to a position of a display panel according to an exemplary embodiment of the inventive concept, and FIG. 3B is a graph illustrating a delay time of a gate signal according to a position of a display panel according to an exemplary embodiment of the inventive concept.

Referring to FIGS. 2 and 3A, a delay time of the gate signal is shown according to the position of the display panel 100 when the gate driver 300 (see FIG. 1) is disposed at one side of the display panel 100.

The gate driver 300 may be disposed at one side of the first display area 100A. The gate driver 300 may provide a gate signal in a direction toward the fourth display area 100D from the first display area 100A. Accordingly, as the gate signal proceeds from the first display area 100A to the fourth display area 100B, the delay time may increase. For example, the delay time increases by a delay time GDT after proceeding through the first display area 100A.

Referring to FIGS. 2 and 3B, a delay time of the gate signal is shown according to the position of the display panel 100, when a plurality of gate drivers are disposed with the display panel 100 disposed therebetween.

The gate drivers may be disposed at both sides of the display panel 100. For example, one first gate driver is disposed at one side of the first display area 100A, and another second gate driver may be disposed at one side of the fourth display area 100D.

The first gate driver provides a gate signal in a direction toward the second display area 100B from the first display area 100A, and the second gate driver may provide a gate signal from the fourth display area 100D toward the third display area 100C. Accordingly, as the gate signal proceeds from the first display area 100A toward the second display area 100B, the delay time increases, and as the gate signal proceeds from the fourth display area 100D toward the third display area 100C, the delay time increases. In other words, the gate signal may be most delayed at the boundary between the second display area 100B and the third display area 100C.

In an exemplary embodiment of the inventive concept, a first gate line disposed in the first display area 100A and the second display area 100B may not be electrically connected to a second gate line disposed in the third display area 100C and the fourth display area 100D. In this case, the first gate line may receive the gate signal from the first gate driver, and the second gate line may receive the gate signal from the second gate driver. In addition, in an exemplary embodiment of the inventive concept, the first gate line may be connected to the second gate line. In this case, the first gate line and the second gate line may all receive the gate signals provided from the first gate driver and the second gate driver.

Figure 4:
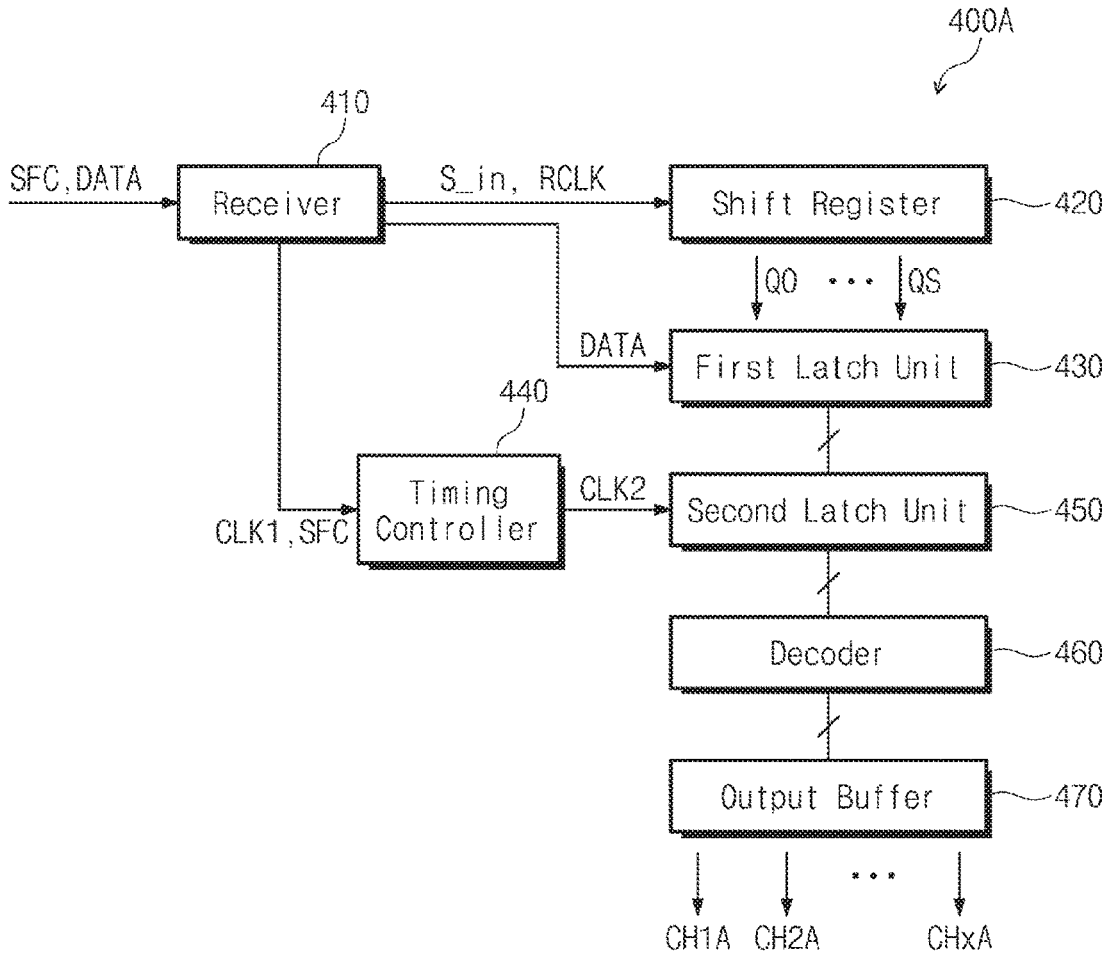
FIG. 4 is a block diagram of a single data driving circuit unit according to an exemplary embodiment of the inventive concept.

FIG. 4 is a block diagram of a single data driving circuit unit according to an exemplary embodiment of the inventive concept. In FIG. 4, the first data driving circuit unit 400A is exemplarily illustrated. The second to fourth data driving circuit units 400B, 400C, and 400D (see FIG. 2) may have substantially the same block diagram as the first data driving circuit unit 400A, and thus the descriptions about the second to fourth data driving circuit units 400B, 400C, and 400D will be omitted.

Referring to FIG. 4, the first data driving circuit unit 400A may include a receiver 410, a shift register 420, a first latch unit 430, a timing controller 440, a second latch unit 450, a decoder 460, and an output buffer 470. Each block element is separated to explain functions thereof. Each block element of the first data driving circuit unit 400A may include a plurality of circuit elements and wirings.

The receiver 410 receives the data DATA and the frame control signal SFC from the signal controller 200 (see FIG. 1). The receiver 410 may include a phase locked loop (PLL) and a phase change logic. The receiver 410 may generate a plurality of clock signals using the PLL. The phase change logic may change phases of the plurality of clock signals.

The shift register 420 sequentially activates a plurality of latch clock signals Q0 to QS in response to register lock signals S_in, RCLK from the receiver 410.

The first latch unit 430 may temporarily store the data DATA in response to the latch clock signals Q0 to QS provided from the shift register 420. The data DATA may be parallelized data. The data DATA may be sequentially stored in the first latch unit 430 and output, in order, to the display panel 100 (see FIG. 2).

The timing controller 440 may receive the first clock signal CLK1 and the frame control signal SFC from the receiver 410. The frame control signal SFC is received from the signal controller 200 (see FIG. 1), and the first clock signal CLK1 may be generated by the receiver 410. For example, the first clock signal CLK1 may be activated when the data DATA corresponding to a single frame is all input to the first data driving circuit unit 400A. The frame control signal SFC may be used for controlling an operation of the PLL or for generating a second clock signal CLK2 to be described later.

The timing controller 440 may generate the second clock signal CLK2 from the first clock signal CLK1 and the frame control signal SFC. The second clock signal CLK2 adjusts a timing when the data DATA stored in the second latch unit 450 via the first latch unit 430 is output to the display panel 100 (see FIG. 2).

According to an exemplary embodiment of the inventive concept, a signal for controlling the output timing of the data DATA is generated using the frame control signal SFC commonly provided to all the first to fourth data driving circuit units 400A, 400B, 400C, and 400D (see FIG. 2). Accordingly, the accuracy of an output timing control among the first to fourth data driving circuit units 400A, 400B, 400C, and 400D may be improved. Accordingly, a luminance difference due to charging time differences among the first to fourth display areas 100A, 100B, 100C, and 100D may be reduced, and the luminance uniformity may be enhanced to improve the display quality.

The second latch unit 450 may receive the parallelized data DATA stored in the first latch unit 430. The second latch unit 450 may transmit the parallelized data DATA to the decoder 460 at a desired timing according to a control by the second clock signal CLK2 received from the timing controller 440.

The decoder 460 may convert the parallelized data DATA stored in the second latch unit 450 to analog data, namely, a gradation voltage. The analog data will be referred to as a data signal hereinafter.

The output buffer 470 may include a plurality of buffers. Each buffer may receive the data signal received from the decoder 460 and output the data signal to the display panel 100 (see FIG. 1). The data may be sequentially output through each of the channels CH1A to CHxA connected to the output buffer 470.

Figure 5:
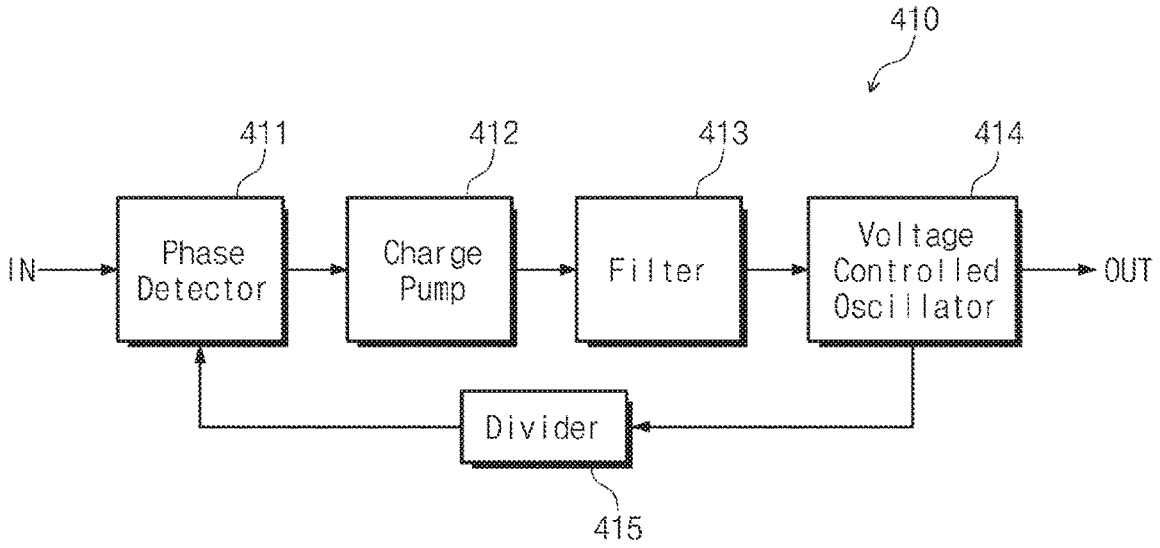
FIG. 5 is a block diagram of a receiver of FIG. 4 according to an exemplary embodiment of the inventive concept.
Figure 6:
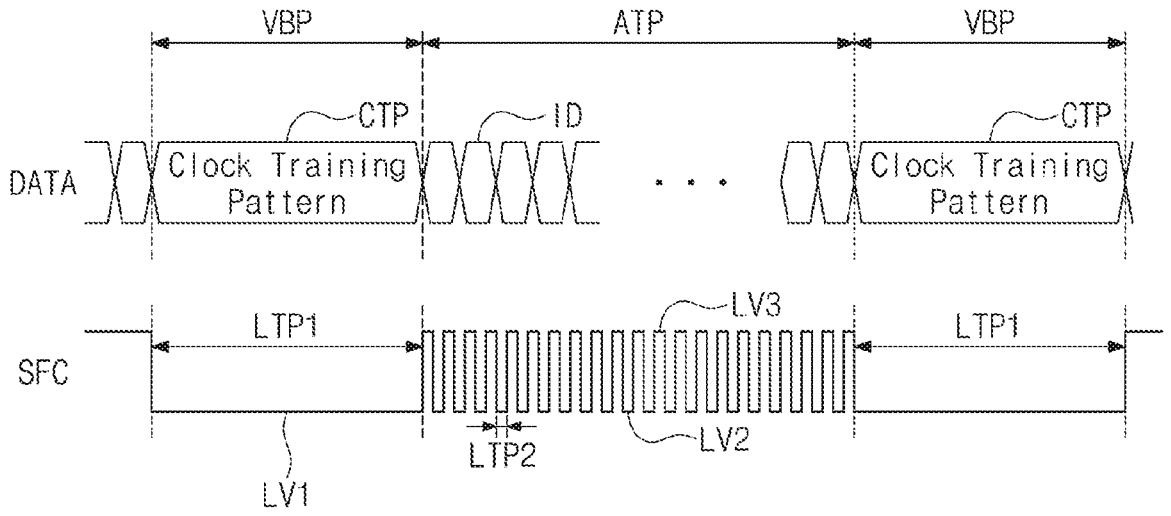
FIG. 6 illustrates data and frame control signals according to an exemplary embodiment of the inventive concept.

FIG. 5 is a block diagram of a receiver of FIG. 4 according to an exemplary embodiment of the inventive concept, and FIG. 6 illustrates data and frame control signals according to an exemplary embodiment of the inventive concept. FIG. 5 illustrates some function blocks among blocks of the receiver 410. In detail, FIG. 5 illustrates a block diagram of the PLL of the receiver 410.

Referring to FIGS. 5 and 6, the receiver 410 may receive the data DATA and the frame control signal SFC.

An interface between the signal controller 200 (see FIG. 1) and the first data driving circuit unit 400A (see FIG. 4) may be Universal Samsung Interface for TV (USI-T). In other words, the receiver 410 may receive the data DATA in which a clock is embedded from the signal controller 200. The data DATA may include image data ID output in an active period ATP and training data CTP output in a blank period VBP. The blank period VBP may be a vertical blank period between one frame and another frame. The training data CTP may include only a clock signal. The training data CTP may be referred to as a training pattern.

The frame control signal SFC may be used at the time of data transmission between the signal controller 200 (see FIG. 1) and the data driver 400 (see FIG. 1). In other words, the frame control signal SFC is commonly provided to the first to fourth data driving circuit units 400A, 400B, 400C, and 400D. The frame control signal SFC may be converted from a high level LV3 to a low level LV1 when the active period ATP is over and the blank period VBP begins.

When the frame control signal SFC has the low level LV1 in the blank period VBP, an internal clock signal may be trained by the PLL in the receiver 410. The training may refer to recovering a frequency of the internal clock signal.

The first data driving circuit unit 400A may recover the frequency of the internal clock signal of the first data driving circuit unit 400A through the PLL. For example, the PLL may extract the clock that has been embedded in the data DATA and transmitted, and recover the frequency of the internal clock signal using the extracted clock. The first data driving circuit unit 400A may be operated using the recovered internal clock signal.

Hereinafter, the training operation by the PLL will be exemplarily described.

The PLL of the receiver 410 may include a phase detector 411, a charge pump 412, a filter 413, a voltage controlled oscillator 414, and a divider 415.

The phase detector 411 may receive two signals, and determine whether there are a frequency difference and a phase difference between the two signals. One of the two signals may be a clock extracted from the data DATA, and the other may be a previously stored internal clock signal. The phase detector 411 may generate a pulse signal corresponding to the phase difference between the two signals.

The charge pump 412 may accumulate a charge in the filter 413 according to the pulse signal and discharge the charges stored in the filter 413. An input voltage to the voltage controlled oscillator 414 may vary according to a change in a charge amount in the filter 413. For example, when the pulse signal has a positive pulse, the charge pump 412 emits charges as much as a charge amount corresponding to the width of the pulse signal. The charges emitted from the charge pump 412 may be accumulated in a capacitor of the filter 413, and the input voltage to the voltage controlled oscillator 414 may be increased. In addition, when the pulse signal has the negative pulse, the charge pump 412 attracts the charges by a charge amount corresponding to the pulse width to reduce the charges accumulated in the capacitor of the filter 413. Accordingly, the input voltage to the voltage controlled oscillator 414 may be decreased.

The filter 413 may have a low pass filter type, and thus filter harmonic signals and a noise signal.

The voltage controlled oscillator 414 may output an output signal of a specific frequency according to the input voltage.

The divider 415 receives the output signal from the voltage controlled oscillator 414. The divider 415 divides the output signal in a constant ratio to change the output signal to have a frequency to be easily compared. The phase detector 411 compares a reference frequency with the frequency of the output signal input from the divider 415, and the above-described operations are repeated.

The frame control signal SFC may have a waveform swinging between a low level LV2 and the high level LV3 in the active period ATP. In the active period ATP, the frame control signal SFC may be used for generating the second clock signal CLK2 (see FIG. 4). A detailed description thereabout will be described in relation to FIGS. 7 to 9.

The low level LV1 in the blank period VBP may be a first level LV1. In the active period ATP, the low level LV2 may be a second level LV2 and the high level LV3 may be a third level LV3.

A time width LTP1 of the first level LV1 may be larger than a time width LPT2 of the second level LV2. The time width LTP1 of the first level LV1 may have a time in which the clock training is sufficiently executed. For example, the time width LTP1 of the first level LV1 may be 1000 T or larger. T may be a value of a single unit interval multiplied by 10.

The first level LV1 and the second level LV2 may have the same level. However, this is merely exemplary, and in an exemplary embodiment of the inventive concept, the first level LV1 and the second level LV2 may have different levels.

In an exemplary embodiment of the inventive concept, even when the frame control signal SFC in the active period ATP is converted from the high level LV3 to the low level LV2, the PLL may not be configured to operate.

In addition, in an exemplary embodiment of the inventive concept, the first data driving circuit unit 400A may further include an operation determination unit configured to determine the operation of the PLL according to the time width or the height of the low level of the frame control signal SFC. For example, when the time width of the low level of the frame control signal SFC is a reference time or longer, the PLL operates; otherwise, the PLL does not operate.

Figure 7:
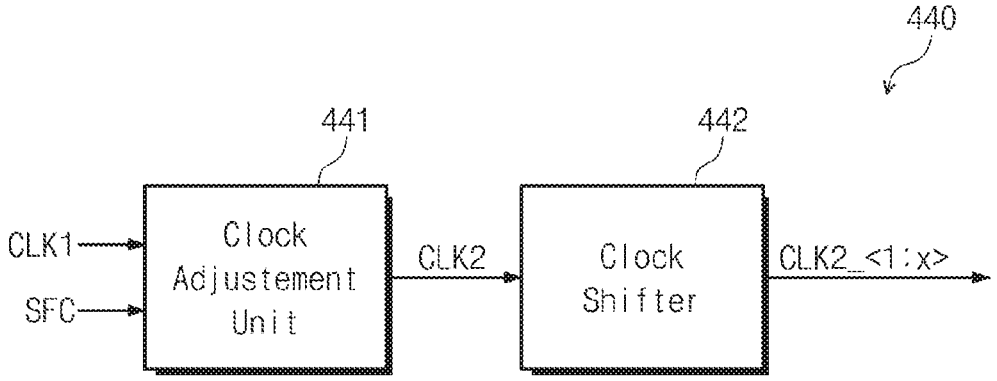
FIG. 7 is a block diagram of a timing controller of FIG. 4 according to an exemplary embodiment of the inventive concept.
Figure 8:
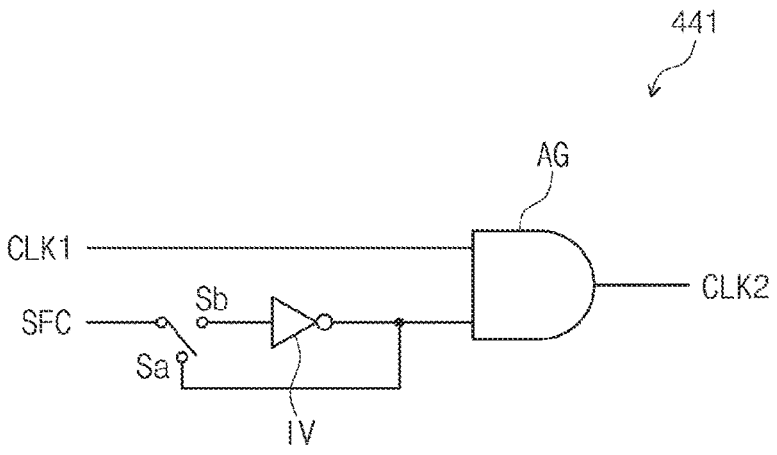
FIG. 8 is a block diagram of a clock adjustment unit of FIG. 7 according to an exemplary embodiment of the inventive concept.
Figure 9:
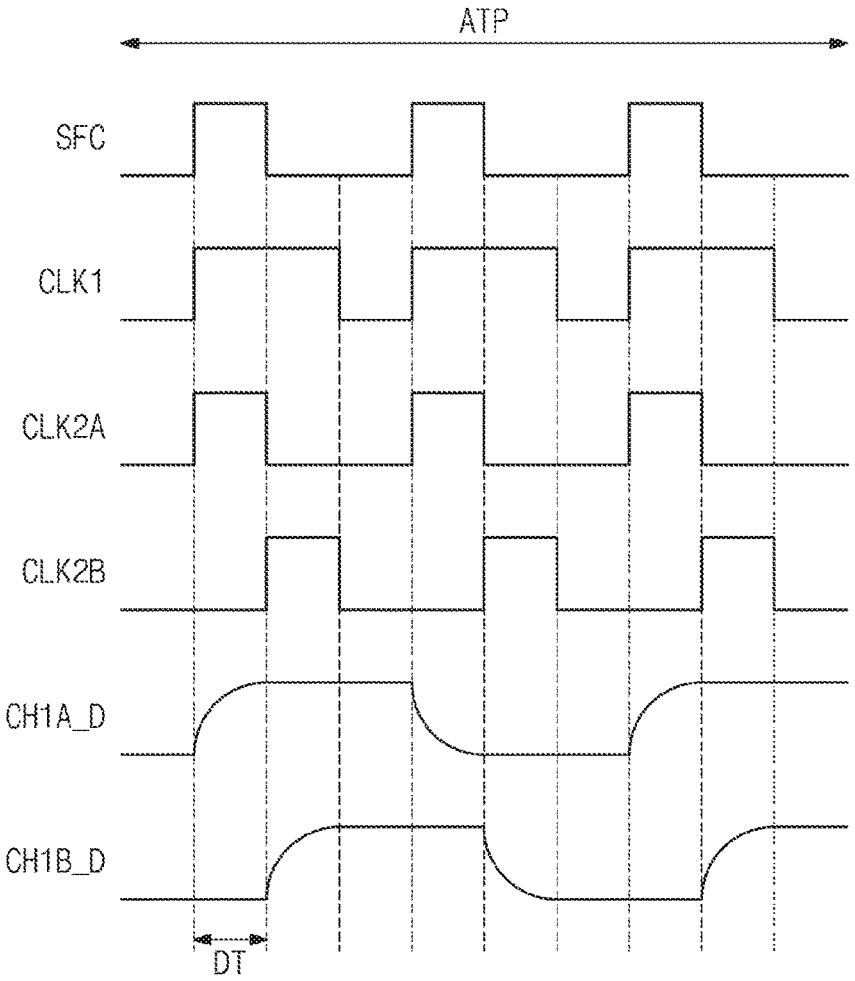
FIG. 9 illustrates signals in an active period according to an exemplary embodiment of the inventive concept.

FIG. 7 is a block diagram of a timing controller of FIG. 4 according to an exemplary embodiment of the inventive concept, FIG. 8 is a block diagram of a clock adjustment unit of FIG. 7 according to an exemplary embodiment of the inventive concept, and FIG. 9 illustrates signals in an active period according to an exemplary embodiment of the inventive concept.

Referring to FIGS. 7 to 9, the timing controller 440 may include a clock adjustment unit 441 and a clock shifter 442.

The clock adjustment unit 441 may generate the second clock signal CLK2 from the first clock signal CLK1 and the frame control signal SFC. The clock shifter 442 may receive the second clock signal CLK2 to generate a plurality of second clock delay signals CLK2_1 to CLK2_x. The second clock signal CLK2 may be substantially identical to a first second clock delay signal CLK2_1. In other words, the second clock signal CLK2 may have substantially the same phase as the first second clock delay signal CLK2_1.

The clock adjustment unit 441 may include a logic, for example, an inverter IV and an AND gate AG.

An input terminal, to which the frame control signal SFC is input, and the AND gate AG may be connected through a first switch Sa. The input terminal, to which the frame control signal SFC is input, and the inverter IV may be connected through a second switch Sb. An output terminal of the inverter of the IV may be connected to the AND gate AG.

For example, a part of the first to fourth data driving circuit units 400A, 400B, 400C, and 400D (see FIG. 2) may be connected, through the first switch Sa, to the input terminal to which the frame control signal SFC is input and the AND gate AG, and the other may be connected, through the second switch Sb, to the input terminal to which the frame control signal SFC is input and the inverter IV.

A description will be provided about, for example, a case where two gate drivers 300 (see FIG. 1) described in relation to FIG. 3B are disposed at both sides of the display panel 100 (see FIG. 1). In this case, the first data driving circuit unit 400A and the fourth data driving circuit unit 400D may be connected, through the first switch Sa, to the input terminal to which the frame control signal SFC is input and the AND gate AG. In addition, the second data driving circuit unit 400B and the third data driving circuit unit 400C may be connected, through the second switch Sb, to the input terminal to which the frame control signal SFC is input and the inverter IV.

FIG. 9 illustrates the frame control signal SFC, the first clock signal CLK1, two second clock signals CLK2A and CLK2B, and two data signals CH1A_D and CH1B_D in the active period ATP.

When the input terminal to which the frame control signal SFC is input and the AND gate AG are connected through the first switch Sa, an AND operation is performed on the first clock signal CLK1 and the frame control signal SFC, and thus the second clock signal CLK2A is generated. When the input terminal to which the frame control signal SFC is input and the inverter IV are connected through the second switch Sb, the frame control signal SFC is inverted. The inverted frame control signal SFC is referred to as an inverted frame control signal. The AND operation is performed on the first clock signal CLK1 and the inverted frame control signal, and thus the second clock signal CLK2B is generated.

The second clock signal CLK2A may be a second clock signal for the first data driving circuit unit 400A and the fourth data driving circuit unit 400D, and the second clock signal CLK2B may be the second clock signal for the second data driving circuit unit 400B and the third data driving circuit unit 400C.

The second clock signals CLK2A and CLK2B may respectively control output timings of data signals to be transmitted to first channels among a plurality of channels. The first channels may refer to channels configured to receive the data signal first in a single data line group.

When the two gate drivers 300 (see FIG. 1) are disposed at both sides of the display panel 100 (see FIG. 1), the first channel of the first data line group DLG1 (see FIG. 2) may be the first channel CH1A, the first channel of the second data line group DLG2 (see FIG. 2) may be the first channel CH1B, the first channel of the third data line group DLG3 (see FIG. 2) may be the x-th channel CHxC (see FIG. 2), and the first channel of the fourth data line group DLG4 (see FIG. 2) may be the x-th channel CHxD (see FIG. 2).

The first data signal CH1A_D among the two data signals CH1A_D and CH1B_D is output to the first channel CH1A and the x-th channel CHxD, and the second data signal CH1B_D among the two data signals CH1A_D and CH1B_D is output to the first channel CH1B and the x-th channel CHxC.

A time interval DT occurring when the first data signal CH1A_D and the second data signal CH1B_D are output may be controlled by adjusting a duty ratio of the frame control signal SFC. In other words, since the time interval DT may be controlled by adjusting the duty ratio of a single signal, it is easier to adjust the time interval DT between the data driving circuit units. The time interval DT may be substantially identical to the delay time GDT of the gate signal shown in FIGS. 3A and 3B. According to an exemplary embodiment of the inventive concept, output timings between adjacent data driving circuit units may be controlled using an existing signal (e.g., the frame control signal SFC) without another additional signal.

Figure 10:
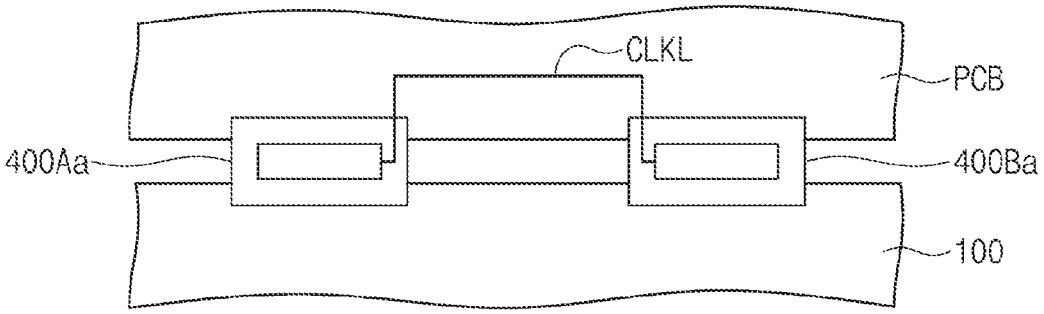
FIG. 10 illustrates a magnified part of a display device according to an exemplary embodiment of the inventive concept.
Figure 11:
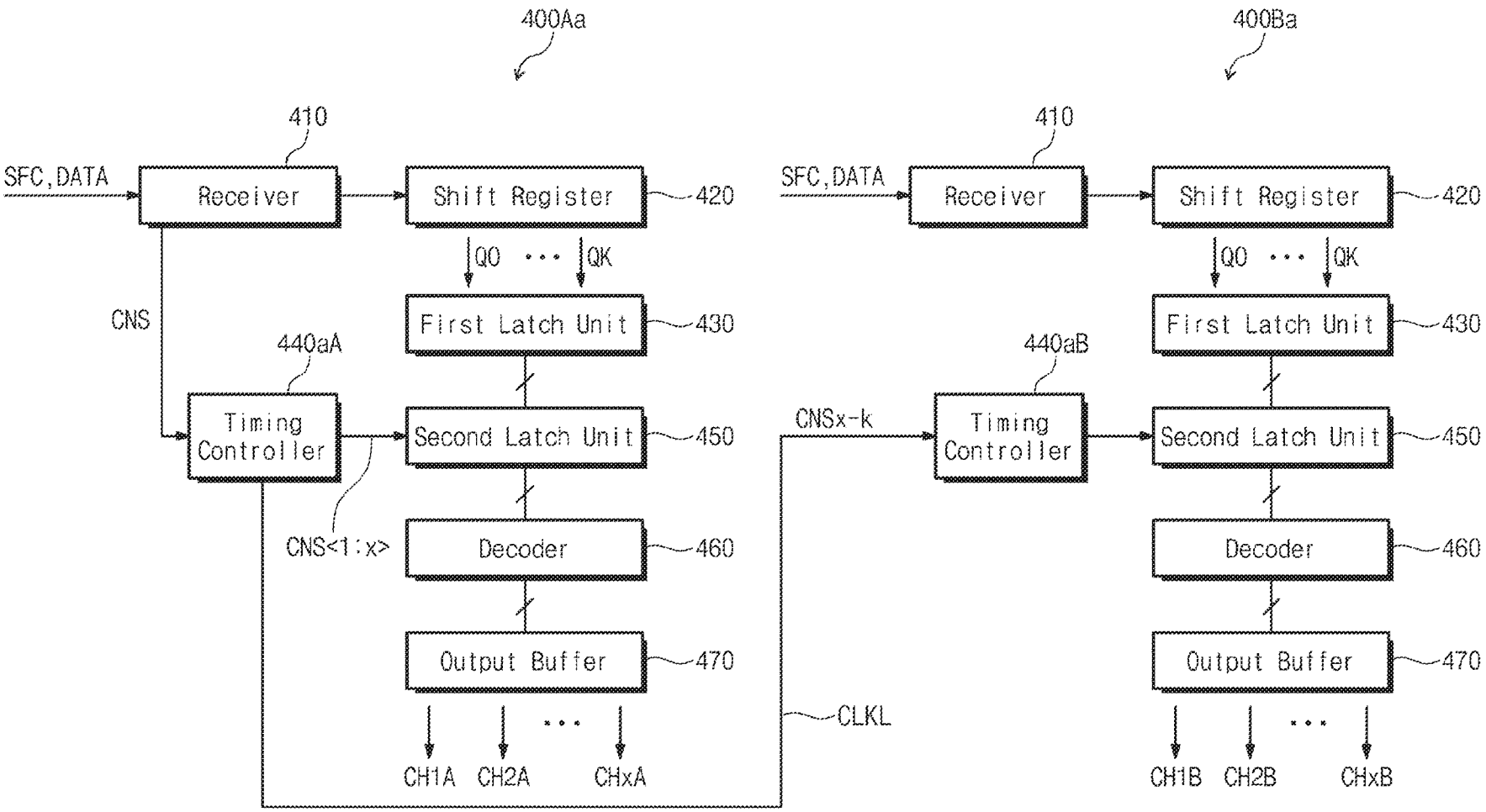
FIG. 11 is a block diagram of two data driving circuit units according to an exemplary embodiment of the inventive concept.
Figure 12:
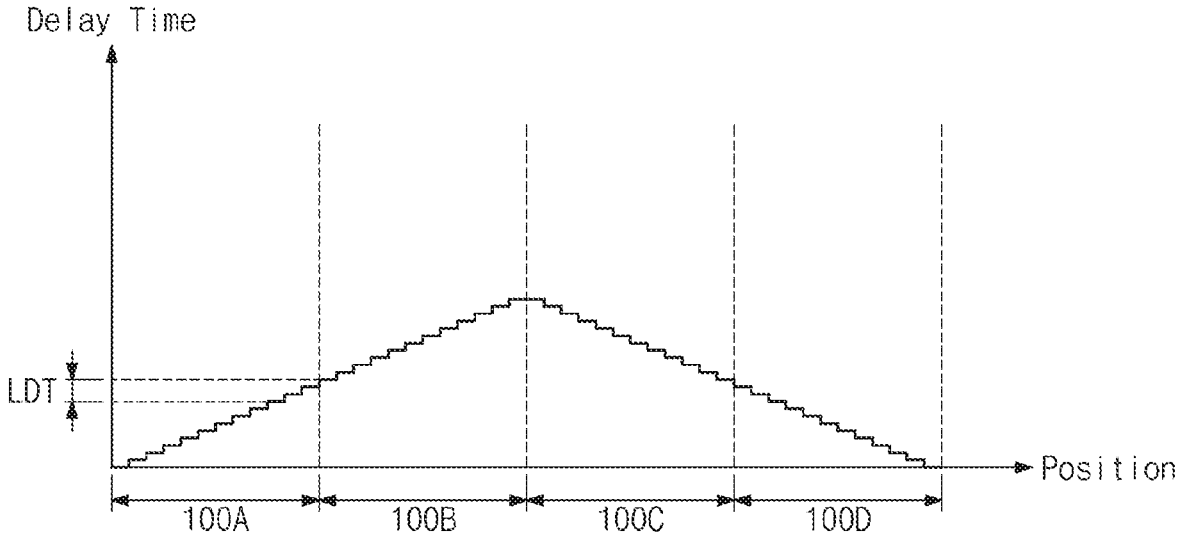
FIG. 12 is a graph illustrating a delay time of a data signal according to a position of a display panel of FIG. 10 according to an exemplary embodiment of the inventive concept.

FIG. 10 illustrates a magnified part of a display device according to an exemplary embodiment of the inventive concept, FIG. 11 is a block diagram of two data driving circuit units according to an exemplary embodiment of the inventive concept, and FIG. 12 is a graph illustrating a delay time of a data signal according to a position of a display panel of FIG. 10 according to an exemplary embodiment of the inventive concept. In describing FIGS. 10 to 12, the same elements as the ones previously described above will be represented with the same reference numerals, and descriptions thereabout will be omitted.

FIGS. 10 to 12 illustrate first and second data driving circuit units 400Aa and 400Ba. Each of the first and second data driving circuit units 400Aa and 400Ba may be implemented by an independent integrated circuit chip and electrically connected to one side of the display panel 100. One terminal of each of the first and second data driving circuit units 400Aa and 400Ba may be connected to the display panel 100, and the other terminal thereof may be connected to a printed circuit board PCB.

The first and second data driving circuit units 400Aa and 400Ba adjacent to each other may be electrically connected to each other through a signal delivery line CLKL. A control signal for controlling an output timing of the data signal may be provided to the signal delivery line CLKL.

A timing controller 440*a*A of the first data driving circuit unit 400Aa may be connected to a timing controller 440*a*B of the second data driving circuit unit 400Ba through the signal delivery line CLKL.

The timing controller 440*a*A may receive the control signal CNS from the receiver 410. The timing controller 440*a*A delays the control signal CNS by a prescribed period to generate a plurality of control-delayed signals CNS1 to CNSx. The control signal CNS may be the same signal as a first control-delayed signal CNS1. In other words, the control signal CNS and the first control-delayed signal CNS1 may have the same phase. Accordingly, control-delayed signals substantially delayed from the control signal CNS may be the second to x-th control-delayed signals CNS2 to CNSx.

The second latch unit 450 is controlled by the control-delayed signals CNS1 to CNSx received from the timing controller 440*a*A to output the parallelized data DATA to the decoder 460 at a prescribed timing.

The timing controller 440*a*B of the second data driving circuit unit 400Ba may receive a control-delayed signal CNSx-k from the outside of the second data driving circuit unit 400Ba. For example, the timing controller 440*a*B may receive the control-delayed signal CNSx-k from the first data driving circuit unit 400Aa.

Here, k may be an integer of 1 or larger and (x-1) or smaller. For example, the x-th control-delayed signal CNSx may be most delayed from the control signal CNS. When the timing controller 440*a*B of the second data driving circuit unit 400Ba receives the x-th control-delayed signal CNSx, the x-th control-delayed signal CNSx may be delayed in a process of delivery through the signal delivery line CLKL. According to an exemplary embodiment of the inventive concept, with reference to a signal delay in the signal delivery line CLKL, a control-delayed signal having an output timing prior to the x-th control-delayed signal CNSx may be provided to the timing controller 440*a*B of the second data driving circuit unit 400Ba.

Referring to FIG. 12, each of the first to fourth display areas 100A, 100B, 100C, and 100D may include 12 channels. A data signal output to each of the channels may be delayed by a prescribed time. A single channel may be delayed by an identical time, and a delay time by which data is output to each channel may be illustrated as a step graph.

FIG. 12 shows the signal delay time LDT in the signal delivery line CLKL. A k-value may be determined with reference to the signal delay time LDT. For example, k may be 2 in FIG. 12, when the signal delay time LDT is considered. The first data driving circuit unit 400Aa may output an (x-2)-th control-delayed signal CNSx-2 to the second data driving circuit unit 400Ba. An output timing of a data signal output to a first channel connected to the second data driving circuit unit 400Ba may be controlled by the (x-2)-th control-delayed signal CNSx-2. The (x-2)-th control-delayed signal CNSx-2 is delayed by the delay time LDT during delivery to the second data driving circuit unit 400Ba through the signal delivery line CLKL. Accordingly, a time interval between an output timing of a data signal output to the last channel connected to the first data driving circuit unit 400Aa and the output timing of the data signal output to the first channel connected to the second data driving circuit unit 400Ba may not be wider than a reference time interval. The reference time interval may correspond to an interval obtained by considering a delay time of a gate signal.

The delay time graph of the data signal according to the position of the display panel of the exemplary embodiments described in relation to FIGS. 4 to 9 may be also similar to that in FIG. 12. Accordingly, in relation to FIGS. 2 to 12, a first time interval between a first output timing of the data signal transmitted to the first channel CH1A of the first data line group DLG1 and a second output timing of the data signal transmitted to the second channel CH2A of the first data line group DLG1 may be substantially the same as a second time interval between a third output timing of the data signal transmitted to the last channel CHxA of the first data line group DLG1 and a fourth output timing of the data signal transmitted to the first channel CH1B of the second data line group DLG2.

According to exemplary embodiments of the inventive concept, an output timing of each of a plurality of data driving circuit units may be controlled using a common frame control signal provided to the plurality of data driving circuit units. Since the output timings of the plurality of data driving circuit units are adjusted using a common signal, accuracy of output timing adjustment may be improved, and the adjustment may be easier. A pixel charging time may be secured for each position in a display panel, and accordingly, a luminance difference in the display panel may be reduced.

In addition, according to exemplary embodiments of the inventive concept, a clock signal for controlling a first output timing of a data driving circuit unit is not a clock signal for controlling the last output timing among clock signals of a data driving circuit unit in a previous stage, but a clock signal for controlling a timing before the last output. In other words, since the first output timing is controlled with reference to a time to be delayed in a process of receiving the clock signal, the output timings of the plurality of data driving circuit units may be consecutively adjusted. Accordingly, the pixel charging time may be secured for each position in the display panel, and as a result, the luminance difference may be reduced in the display panel.

While the inventive concept has been described with reference to exemplary embodiments thereof, it will be clear to those of ordinary skill in the art that various changes and modifications in form and details may be made thereto without departing from the spirit and scope of the inventive concept as set forth in the following claims.

What is claimed is:

1. A display device comprising:

a signal controller configured to provide data and a frame control signal;

a display panel comprising first to m-th data line groups, where m is a positive integer of 2 or greater; and a data driver configured to receive the data and the frame control signal, and output a data signal corresponding to the data to the first to m-th data line groups, wherein the data driver comprises first to m-th data driving circuit units electrically connected to the first to m-th data line groups in one-to-one correspondence, wherein the first to m-th data driving circuit units receive the frame control signal, wherein each of the first to m-th data driving circuit units comprises a clock adjustment unit configured to generate a second clock signal using a first clock signal and the frame control signal, and wherein the second clock signal controls an output timing of the data signal to be transmitted to a first channel among a plurality of channels of each of the first to m-th data line groups.

2. The display device of claim 1, wherein active periods, in each of which the data signal is output to the display panel, and a blank period between the active periods are defined, wherein the frame control signal has a first level in the blank period, and wherein the frame control signal swings between a second level and a third level higher than the second level in the active periods.

3. The display device of claim 2, wherein a time width of the first level is larger than that of the second level, and the first level and the second level have a substantially identical level.

4. The display device of claim 2, wherein each of the first to m-th data driving circuit units adjusts a frequency of an internal clock signal in response to the first level of the frame control signal.

5. The display device of claim 1, wherein when the data corresponding to one fray re is input to each of the first to m-th data driving circuit units, the first clock signal is activated.

6. The display device of claim 1, wherein each of the first to m-th data driving circuit units further comprises a clock shifter configured to receive the second clock signal to generate a plurality of second clock-delayed signals, and the plurality of second clock-delayed signals control an output timing of the data signal to be transmitted to each channel except the first channel among the plurality of channels.

7. The display device of claim 6, wherein a first time interval between a first output timing of the data signal to be transmitted to the first channel of the first data line group and a second output timing of the data signal to be transmitted to a second channel of the first data line group is substantially identical to a second time interval between a third output timing of the data signal to be transmitted to a last channel of the first data line group and a fourth timing of the data signal to be transmitted to a first channel of the second data line group.

8. The display device of claim 1, wherein a part of the first to m-th data driving circuit units performs an AND operation on the first clock signal and the frame control signal to generate the second clock signal, and another part of the first to m-th data driving circuit units generates an inverted frame control signal from the frame control signal and performs an AND operation on the inverted frame control signal and the first clock signal to generate the second clock signal.

9. The display device of claim 1, wherein the clock adjustment unit comprises an inverter and an AND gate.

10. The display device of claim 1, wherein a duty ratio of the frame control signal is adjusted to adjust a time interval between a first output timing of the data signal to be transmitted to a first channel of the first data line group and a second output timing of the data signal to be transmitted to a first channel of the second data line group.

11. The display device of claim 1, wherein each of the first to m-th data driving circuit units further comprises:

a shift register configured to output latch clock signals;

a first latch unit configured to receive the data in correspondence to the latch clock signals, and a second latch unit configured to receive the data from the first latch unit and the second clock si enal from the clock adjustment unit, wherein the second latch unit outputs the data at a prescribed timing according to a control of the second clock signal.

12. The display device of claim 11, wherein each of the first to m-th data driving circuit units further comprises:

a decoder configured to convert the data stored in the second latch unit to the data signal in a period in which the second clock signal is activated; and an output buffer configured to output the data signal to the display panel.

13. A display device comprising:

a signal controller configured to provide a frame control signal, and data comprising image data output in an active period and training data output in a blank period;

a display panel comprising first to m-th data line groups, where m is a positive integer of 2 or greater; and a data driver comprising first to m-th data driving circuit units electrically connected to first to m-th data line groups in one-to-one correspondence, wherein each of the first to m-th data driving circuit units comprises a clock adjustment unit configured to use the frame control signal and a first clock signal to generate a second clock signal for controlling an output timing of a data signal corresponding to the image data, and wherein the frame control signal has a waveform having a low level in the blank period, and swinging between the low level and a high level in the active period.

14. The display device of claim 13, wherein a phase difference between the second clock signal generated by the clock adjustment unit of the first data driving circuit unit and the second clock signal generated by the clock adjustment unit of the second data driving circuit unit is determined by a duty ratio of the frame control signal in the active period.

15. The display device of claim 13, wherein the clock adjustment unit of the first data driving circuit unit performs an AND operation on the first clock signal and the frame control signal to generate the second clock signal, and the clock adjustment unit of the second data driving circuit unit, which is adjacent to the first data driving circuit unit, performs an AND operation on the first clock signal and an inverted frame control signal obtained by inverting the frame control signal to generate the second clock signal.

16. The display device of claim 13, wherein each of the first to m-th data line groups comprises a plurality of channels, and wherein the second clock signal controls an output timing of a first channel, through which the image data is output first, among the plurality of channels.

17. The display device of claim 16, wherein each of the first to m-th data driving circuit units further comprises a clock shifter configured to receive the second clock signal to generate a plurality of second clock-delayed signals, and wherein the plurality of second clock-delayed signals control an output timing of the data signal to be transmitted to each of the plurality of channels except the first channel.

18. A display device comprising:

a display panel comprising first to m-th data line groups, where in is a positive integer of 2 or greater; and a data driver comprising first to m-th data driving circuit units electrically connected to first to m-th data line groups in one-to-one correspondence, wherein at least one v-th data driving circuit unit, where y is an integer of 2 to m, among the first to m-th data driving circuit units, comprises a timing controller configured to receive a control signal from a (y-1)-th data driving circuit unit and generate control-delayed signals using the control signal, and wherein each of the first to in-th data line groups is divided into x channels, where x is an integer of 2 or greater, and the control signal controls an output timing of a data signal corresponding to the data to be transmitted to an (x-k)-th channel, where k is an integer of 1 to (x-1), of the (y-1)-th data driving circuit unit.

19. The display device of claim 18, wherein the control signal controls an output timing of a data signal corresponding to the data to be transmitted to a first channel of the y-th data driving, circuit unit, and each of the control-delayed signals controls an output timing of the data signal to be transmitted to each of the x channels except for the first channel of the y-th data driving circuit unit.

20. The display device of claim 19, further comprising:

a signal delivery line connecting the y-th data driving circuit unit to the (y-1)-th data driving circuit unit, wherein the control signal is delivered from the (y-1)-th data driving circuit unit to the y-th data driving circuit unit through the signal delivery line.

* * * * *